United States Patent [19]

Geary

[11] Patent Number: 4,535,380

[45] Date of Patent: Aug. 13, 1985

[54] IGNITION SYSTEM

[75] Inventor: Frederick J. Geary, Holland, Mich.

[73] Assignee: Robertshaw Controls Company, Richmond, Va.

[21] Appl. No.: 613,183

[22] Filed: May 23, 1984

[51] Int. Cl.[3] ..... F23Q 3/01; F02P 3/08

[52] U.S. Cl. ..... 361/256; 315/209 SC; 431/264

[58] Field of Search ..... 361/256; 315/256, 209 SC; 431/264; 354/145.1

[56] References Cited

U.S. PATENT DOCUMENTS

| | | | |
|---|---|---|---|
| 3,839,659 | 10/1974 | Bruijning et al. | 315/209 SC |
| 4,012,749 | 3/1977 | Numata | 354/145.1 |
| 4,115,832 | 9/1978 | Nakamura et al. | 361/256 |
| 4,339,695 | 7/1982 | Siglock | 315/256 X |

OTHER PUBLICATIONS

Electronics, Australia, May 1975, Simpson, pp. 48 and 49.

*Primary Examiner*—Donald A. Griffin

*Attorney, Agent, or Firm*—Harold W. Adams

[57] ABSTRACT

An ignition system adapted to generate high frequency and high energy arcs between electrodes effective to initiate combustion of fuels, such as manufactured or natural gas, supplied for heating purposes to residential furnaces, appliances and the like, the ignition system including low voltage control circuitry enabling the use of high voltage breakover devices in high voltage pulse generator circuitry incorporated in the ignition system without requiring the use of high voltage switches for controlling the conduction of the high voltage breakover devices.

21 Claims, 6 Drawing Figures

IGNITION SYSTEM

BRIEF SUMMARY OF THE INVENTION

This invention relates to ignition systems and, more particularly, to an improved ignition system, incorporating improved high voltage circuitry and improved low voltage control circuitry, and effective to produce high frequency and high energy arcs between electrodes for the purpose of initiating combustion of fuels, such as manufactured or natural gas, employed for heating purposes in residential furnaces and appliances such as ovens, water heaters, dryers and the like.

Heretofore, ignition systems have been provided for residential furnaces and appliances, such as ovens, water heaters, dryers and the like, for the purpose of igniting fuel, such as manufactured or natural gas, supplied to the furnace or appliance for heating purposes. Such ignition systems have become increasingly complicated and expensive and are often inefficient, difficult to service because of the complicated circuitry incorporated therein, and susceptible to failure because of the large number of components utilized therein.

An object of the present invention is to overcome the aforementioned as well as other disadvantages in prior ignition systems of the indicated character and to provide an improved ignition system incorporating improved means for producing high frequency and high energy arcs between electrodes effective to initiate combustion of fuels, such as manufactured or natural gas, supplied for heating purposes to residential furnaces and appliances such as ovens, water heaters, dryers and the like.

Another object of the invention is to reduce the cost and improve the efficiency and reliability of ignition systems for residential furnaces and appliances.

Another object of the present invention is to provide an improved ignition system incorporating improved low voltage control means for controlling the generation of high frequency and high energy arcs effective to initiate combustion of manufactured or natural gas supplied to residential furnaces and appliances for heat generation purposes.

Another object of the present invention is to provide improved low voltage control means for high voltage ignition systems, which control means may, if desired, be isolated from high line voltage.

Another object of the present invention is to provide an improved ignition system which may be readily adapted to meet the ignition requirements of a wide variety of residential furnaces and appliances employing manufactured or natural gas for heating purposes.

Another object of the present invention is to provide an improved ignition system incorporating improved low voltage control means which enables the use of a high voltage breakover device, commonly known as a Sidac or a Unilateral Trigger, in the high voltage circuitry of the system without requiring the use of other high voltage switches for controlling the conduction of the high voltage breakover device.

Another object of the present invention is to provide an improved ignition system incorporating efficient and reliable low voltage control means for controlling a breakover device incorporated in the high voltage circuitry of the ignition system.

Another object of the present invention is to provide an improved ignition system which prevents a breakover device of the indicated character incorporated in the high voltage circuitry of the system from reaching breakover voltage in one mode of control and which allows the breakover device to reach breakover voltage in the opposite mode.

Another object of the present invention is to provide an improved ignition system which may be economically manufactured and assembled for use with a wide variety of residential furnaces and appliances employing manufactured or natural gas for heating purposes and which ignition system is durable, efficient and reliable in operation.

The above as well as other object and advantages of the present invention will become apparent from the following description, the appended claims and the accompanying drawings.

DETAILED DESCRIPTION

In general, ignition systems embodying the present invention include a high voltage pulse generating circuit, a combustion initiator circuit, and a low voltage control circuit, the high voltage pulse generating circuit including a commercially available high voltage breakover device commonly known as a Sidac or a Unilateral Trigger, which is a semiconductor device somewhat similar to a triac or a silicon controlled rectifier in the unilateral configuration and includes internal voltage sensing circuitry which causes turn on or conduction of the voltage breakover device when a specified voltage is obtained. The breakover device is placed in series with the primary winding of a high voltage step up transformer, and this series arrangement is placed in parallel with a discharge capacitor which is fed through a series resistor by a DC voltage. When the voltage across the capacitor reaches the breakdown voltage of the breakover device, as for example 205 to 220 volts DC, the breakover device triggers and conducts and allows the capacitor to discharge through the primary winding of the high voltage transformer thereby causing a high voltage discharge at the secondary winding of the transformer which is applied to spaced electrodes placed in the vicinity of the fuel, and the resulting arcs or sparks across the spaced electrodes are effective to ignite the fuel, the repetition rate being established by the magnitude of the DC voltage and the R-C time constant of the discharge capacitor and the series feed resistor. Systems embodying the present invention include low voltage control circuitry which enables the use of a breakover device in the high voltage circuitry without requiring the use of other high voltage switching means to control the conduction of the breakover device, it being well known that it is often not permissible under applicable safety standards, or practical, to switch high voltage circuits with low voltage switches, such as conventional residential thermostats, with the result that the use of such high voltage breakover devices has been prohibited or inhibited because of the inability of the low voltage switches associated with the furnace or appliance to switch high voltage circuits and the necessity of providing additional high voltage switches to control the conduction of the breakover devices.

Figure 1:
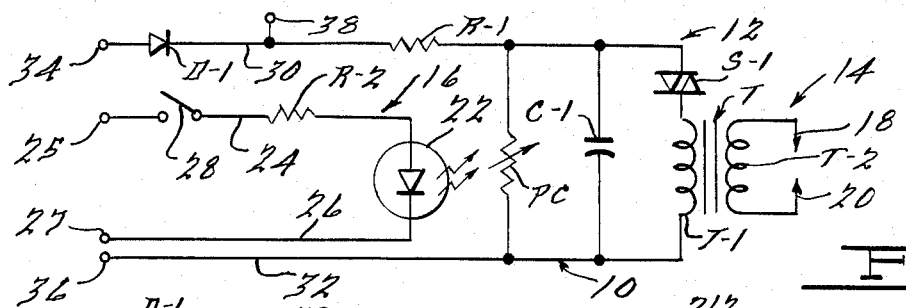
FIG. 1 is a schematic circuit diagram of an ignition system embodying the present invention.

Referring to the drawings, and more particularly to FIG. 1 thereof, a schematic diagram of an ignition system, generally designated 10, embodying the present invention is illustrated therein. The system 10 includes a high voltage pulse generating circuit, generally designated 12, a combustion initiator circuit, generally designated 14, and a low voltage control circuit, generally designated 16, the components incorporated in the above described circuitry all being electrically connected by suitable conductors as illustrated in the drawings and as will be described hereinafter in greater detail.

The high voltage pulse generating circuit 12 includes a diode D-1 and a resistor R-1 connected in series therewith; a breakover device S-1 connected in series with the diode D-1 and the Resistor R-1; the primary winding T-1 of a step up transformer T connected in series with the breakover S-1; a capacitor C-1 connected in parallel with the series combination of the breakover device and the primary winding of the transformer T; and a photoelectric cell PC connected in a voltage divider path across the capacitor C-1. The photoelectric cell PC is of the type wherein the absence of light impinging on the active face thereof causes the resistance of the photoelectric cell to be extremely high while the presence of light on the active face thereof causes the resistance of the photoelectric cell to become low.

The combustion initiator circuit 14 includes the secondary winding T-2 of the transformer T, and spaced electrodes 18 and 20 connected to the opposite ends, respectively, of the secondary winding T-2, the electrodes 18 and 20 being located in proximity to the fuel which is to be ignited.

The low voltage control circuit 16 includes a low voltage light source 22 which may be in the form of a light emitting diode, a low voltage incandescent lamp, a low voltage fluorescent lamp or other suitable low voltage source of light, the light source 22 being positioned so that light emanating therefrom impinges on the active face of the photoelectric cell PC. The leads 24 and 26 of the control circuit 16 are adapted to be connected to the terminals 25 and 27 of any suitable source of low voltage AC or DC current, as for example two volts AC or DC current, a low voltage switch 28 being connected in the lead 24 for controlling the energization of the light source 22. If desired, resistor R-2 may also be incorporated in the lead 24 for controlling the voltage applied to the light source. The low voltage switch 28 may be in the form of a conventional thermostatic switch, a manually actuatable switch, a solid state switch, or any other switching means effective to control the energization of the light source 22 by making and breaking the circuit thereto.

As shown in FIG. 1, the leads 30 and 32 of the high voltage pulse generating circuit 12 are adapted to be connected to terminals 34 and 36, respectively, of a conventional source of line voltage alternating current, such as conventional nominal 115 volt alternating current. In the alternative, the lead 34 of the high voltage pulse generating circuit 12 may be connected to the terminal 38 of a conventional source of high voltage DC current of the desired value while the lead 32 of the high voltage pulse generating circuit is connected to ground.

In the operation of the embodiment of the invention illustrated in FIG. 1, when the switch 28 is open, the light source 22 is deenergized, and the absence of light impinging on the active face of the photoelectric cell PC causes the resistance thereof to be extremely high thereby allowing the capacitor C-1 to charge to the breakover voltage of the breakover device S-1. When the voltage across the capacitor C-1 reaches the breakover voltage of the breakover device, the breakover device triggers and conducts and allows the capacitor C-1 to discharge through the primary winding T-1 of the high voltage transformer T thereby causing a high voltage discharge at the secondary winding T-2 of the transformer, which discharge is applied to the spaced electrodes 18 and 20 that are disposed in proximity to the fuel, and the resulting arcs or sparks across the spaced electrodes are effective to ignite the fuel, the repetition rate being established by the magnitude of the DC voltage and the R-C time constant of the discharge capacitor C-1 and the resistor R-1.

When the switch 28 is closed, the light source 22 is energized thereby causing the photoelectric cell PC to have a low resistance, and the voltage divider action thereof prevents the capacitor C-1 from ever charging to the breakover device breakover voltage with the result that the spark discharge is inhibited until such time as the light source 22 is again deenergized by the opening of the swith 28.

Figure 2:
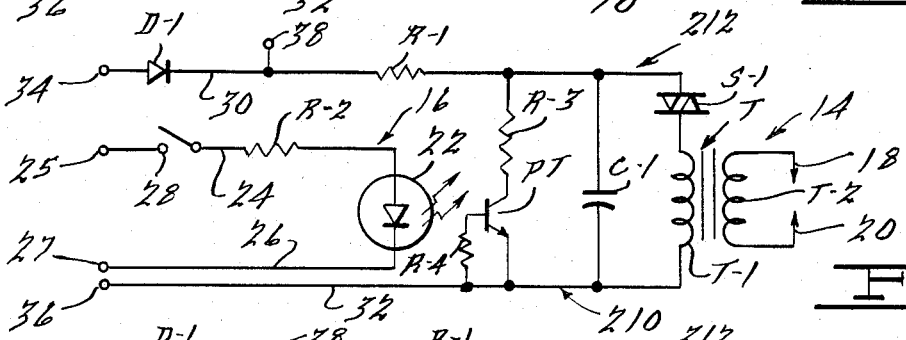
FIG. 2 is a schematic circuit diagram of another embodiment of the invention.

Another embodiment of the invention is illustrated in FIG. 2 and is comprised of an ignition system, generally designated 210, which includes the combustion initiator circuit, generally designated 14, previously described, and the low voltage control circuit, generally designated 16, previously described. In this embodiment of the invention, a high voltage pulse generator circuit, generally designated 212, is provided wherein the photoelectric cell PC of the high voltage pulse generator circuit 12, previously described in connection with FIG. 1, is replaced by a phototransistor PT as illustrated in FIG. 2. The high voltage pulse generator circuit 212 includes the diode D-1 and resistor R-1 connected in series therewith; the breakover device S-1 connected in series with the diode D-1 and the resistor R-1; the primary winding T-1 of the step up transformer T connected in series with the breakover device; and the capacitor C-1 connected in parallel with the series combination of the breakover device and the primary winding of the transformer T. The phototransistor PT is connected in a voltage divider path across the capacitor C-1. The base of the phototransistor PT is connected to the lead 32 through a resistor R-4 as illustrated in FIG. 2 to prevent conduction of the phototransistor due to temperature changes or other extraneous factors.

The phototransistor PT is preferably of the type wherein the absence of light impinging thereon from the light source 22 results in nonconduction of the phototransistor whereas when light impinges thereon from the light source 22, such device conducts and shunts current between the leads 28 and 30 in parallel with the capacitor C-1. If desired, a resistor R-3 may also be incorporated in the voltage divider path for controlling the voltage applied to the phototransistor.

In the operation of the embodiment of the invention illustrated in FIG. 2, when the switch 28 is open, the light source 22 is deenergized and the absence of light impinging on the phototransistor PT, with the appropriate resistor R-3 in series therewith if necessary, results in nonconduction or extremely high resistance through the shunt or voltage divider path thereby allowing the capacitor C-1 to charge to the breakover device breakover voltage. When the voltage across the capacitor C-1 reaches the breakover voltage of the breakover device S-1, the breakover device triggers and conducts and allows the capacitor C-1 to discharge through the primary winding T-1 of the high voltage transformer T in the manner previously described with the result that the high voltage discharge from the secondary winding T-2 of the transformer is applied to the spaced electrodes 18 and 20, and the resulting arcs or sparks across the spark gap therebetween are effective to ignite the fuel in the manner previously described, the repetition rate being established by the magnitude of the DC voltage and the R-C time constant of the capacitor C-1 and the resistor R-1. When the switch 28 is closed, the resultant energization of the light source 22 and consequent reduction in resistance of the phototransistor PT prevents the capacitor C-1 from charging to the breakover voltage of the breakover device thereby inhibiting arc discharge in the manner previously described.

Figure 3:
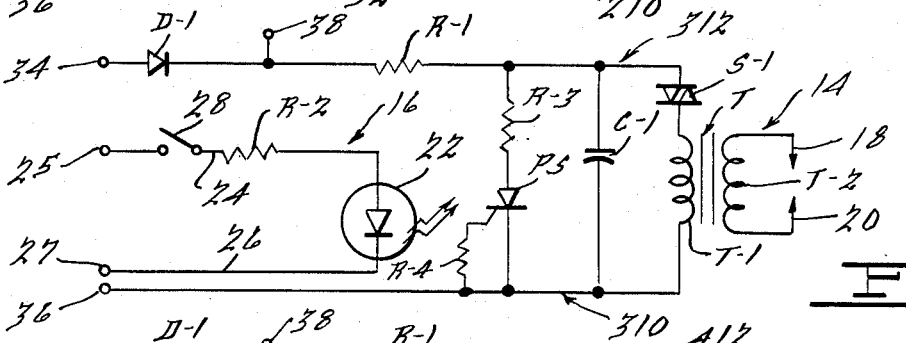
FIG. 3 is a schematic circuit diagram of another embodiment of the invention.

Another embodiment of the invention is illustrated in FIG. 3 and is comprised of an ignition system, generally designated 310, which includes the combustion initiator circuit, generally designated 14, previously described, and the low voltage control circuit, generally designated 16, previously described. In this embodiment of the invention, a high voltage pulse generator circuit, generally designated 312, is provided wherein the phototransistor PT of the high voltage pulse generator circuit 212, previously described in connection with FIG. 2, is replaced by a photocoupling device which may be in the form of a photo silicon controlled rectifier PS, or a photo programmable unijunction transistor, a photo triac, or other comparable device, a photo silicon controlled rectifier being illustrated for generic purposes. The high voltage pulse generator circuit 312 includes the diode D-1 and resistor R-1 connected in series therewith; the breakover device S-1 connected in series with the diode D-1 and the resistor R-1; the primary winding T-1 of the step up transformer T connected in series with the breakover device; and the capacitor C-1 connected in parallel with the series combination of the breakover device and the primary winding of the transformer T. The photo silicon controlled rectifier or photo programmable unijunction transistor or photo triac (collectively designated as PS) is connected in a voltage divider path across the capacitor C-1. The base of the photo silicon controlled rectifier or comparable device is connected to the lead 32 through a resistor R-4 as illustrated in FIG. 3 to prevent conduction of the photo silicon controlled rectifier due to temperature changes or other extraneous factors.

The photo silicon controlled rectifier PS is preferably of the type wherein the absence of light impinging thereon from the light source 22 results in nonconduction of the device whereas when light impinges thereon from the light source 22, such device conducts and shunts current between the leads 28 and 30 in parallel with the capacitor C-1. If desired, a resistor R-3 may also be incorporated in the voltage divider path for controlling the voltage applied to the photo silicon controlled rectifier or comparable device.

In the operation of the embodiment of the invention illustrated in FIG. 3, when the switch 28 is open, the light source 22 is deenergized and the absence of light impinging on the photo silicon controlled rectifier PS, with the appropriate resistor R-3 in series therewith if necessary, results in nonconduction or extremely high resistance through the shunt or voltage divider path thereby allowing the capacitor C-1 to charge to the breakover device breakover voltage. When the voltage across the capacitor C-1 reaches the breakover voltage of the breakover device S-1, the breakover device triggers and conducts and allows the capacitor C-1 to discharge through the primary winding T-1 of the high voltage transformer T in the manner previously described with the result that the high voltage discharge from the secondary winding T-2 of the transformer is applied to the spaced electrodes 18 and 20, and the resulting arcs or sparks across the spark gap therebetween are effective to ignite the fuel in the manner previously described, the repetition rate being established by the magnitude of the DC voltage and the R-C time constant of the capacitor C-1 and the resistor R-1. When the switch 28 is closed, the resultant energization of the light source 22 and consequent reduction in the resistance of the photo silicon controlled rectifier PS prevents the capacitor C-1 from charging to the breakover voltage of the breakover device thereby inhibiting arc discharge in the manner previously described.

Figure 4:
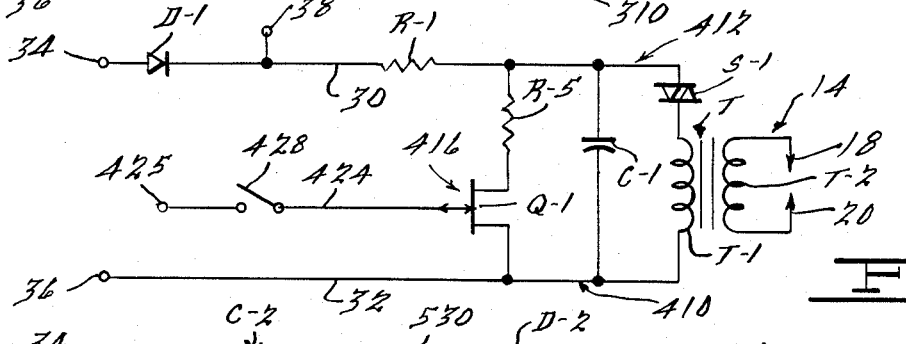
FIG. 4 is a schematic circuit diagram of another embodiment of the invention.

Another embodiment of the invention is illustrated in FIG. 4 and is comprised of an ignition system, generally designated 410, which includes the combustion initiator circuit, generally designated 14, previously described. In this embodiment of the invention, a high voltage pulse generator circuit, generally designated 412, is provided wherein the photoelectric cell PC of the high voltage pulse generator circuit 12, previously described in connection with FIG. 1, or the photocoupler devices PT and PS, previously described in connection with FIGS. 2 and 3, respectively, is replaced by a field effect transistor Q-1 which may be either of the enhancement type or the depletion type. In this embodiment of the invention, the high voltage pulse generator circuit 412 includes the diode D-1 and resistor R-1 connected in series therewith; the breakover device S-1 connected in series with the diode D-1 and the resistor R-1; the primary winding T-1 of the step up transformer T connected in series with the breakover device; and the capacitor C-1 connected in parallel with the series combination of the breakover device and the primary winding of the transformer T. If desired, a resistor R-5 may be connected in series with the field effect transistor Q-1 in the shunt or voltage divider path across the capacitor C-1.

In this embodiment of the invention, a low voltage control circuit, generally designated 416 is provided comprised of a signal lead 424 connected to the gate of the field effect transistor and to a source of low voltage, such as for example 2 volts, through a switch 428 whereby pinchoff voltage may be applied to the gate of the field effect transistor.

In the operation of this embodiment of the invention, when the switch 428 is closed, pinchoff voltage is applied to a depletion type field effect transistor Q-1, and the field effect transistor does not conduct thereby alowing the capacitor C-1 to charge to the breakover device breakover voltage. When the voltage across the capacitor C-1 reaches the breakover voltage of the breakover device S-1, the breakover device triggers and conducts and allows the capacitor C-1 to discharge through the primary winding T-1 of the transformer T in the manner previously described with the result that the high voltage discharge from the secondary winding T-2 of the transformer is applied to the spaced electrodes 18 and 20, and the resulting arcs or sparks across the spark gap therebetween are effective to ignite the fuel in the manner previously described. When the switch 428 is opened, the absence of pinchoff voltage applied to the field effect transistor Q-1 causes the field effect transistor to conduct, and the voltage divider action thereof prevents the capacitor C-1 from charging to the breakover device breakover voltage with the result that the spark charge is inhibited until such time as the pinchoff voltage is again applied to the field effect transistor by closing the switch 428 to turn off the field effect transistor. It will be noted that this embodiment of the invention does not provide isolation from the line voltage as do the embodiments of the invention illustrated in FIGS. 1, 2 and 3, but this embodiment is suitable for use in ignition systems utilizing line voltage control means. It will also be understood that either enhancement type or depletion type field effect transistors may be utilized, enhancement type field effect transistors conducting when a control signal is applied thereto while depletion type field effect transistors are open when a control signal is applied thereto.

Figure 5:
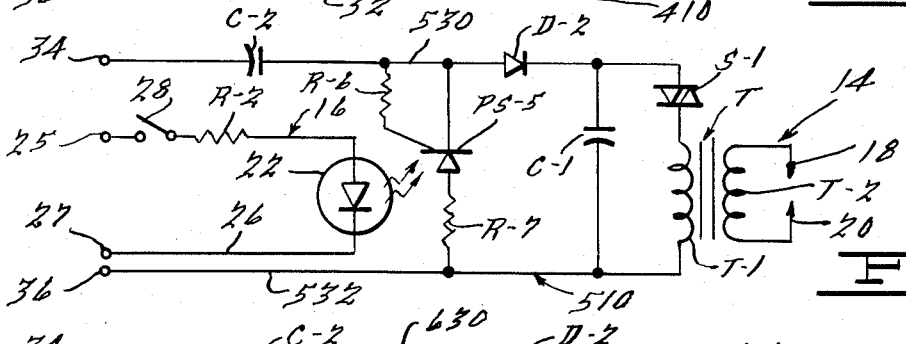
FIG. 5 is a schematic circuit diagram of still another embodiment of the invention.

Another embodiment of the invention is illustrated in FIG. 5 and is comprised of an ignition system, generally designated 510. The ignition system 510 includes the combustion initiator circuit, generally designated 14, previously described, and the low voltage control circuit generally designated 16, previously described. In this embodiment of the invention, a high voltage pulse generator circuit, generally designated 512, is provided which includes the breakover device S-1; the primary winding T-1 of the step up transformer T connected in series with the breakover device; and the capacitor C-1 connected in parallel with the series combination of the breakover device and the primary winding of the transformer T. As shown in FIG. 5, the leads 530 and 532 of the high voltage pulse generating circuit 512 are adapted to be connected to the terminals 34 and 36, respectively, of a conventional source of line voltage alternating current, such as conventional nominal 115 volt alternating current. This embodiment of the invention also includes a capacitor C-2 and a diode D-2 connected in series. In this embodiment of the invention a voltage doubler circuit is provided which includes a photocoupling device PS-5 which may be in the form of a photo silicon controlled rectifier, a photo programmable unijunction transistor, a photo triac or other comparable device, the photocoupling device PS-5 being connected to the lead 530 intermediate the capacitor C-2 and the diode D-2, and to the lead 532 through a resistor R-7. The gates of the photo silicon controlled rectifier, or the photo programmable unijunction transistor or the photo triac are preferably connected to the lead 530 through a suitable resistor R-6. In this embodiment of the invention if the photocoupling device PS-5 does not conduct, the capacitor C-1 can never attain the necessary breakover voltage for the breakover device S-1. When light emanating from the light source 22 impinges on the photocoupling device PS-5, the photo silicon controlled rectifier, photo programmable unijunction transistor or photo triac conducts thus doubling the input voltage and causing the breakover device S-1 to breakover thereby effecting ignition in the manner previously described. Opening of the switch 28 with the resulting absence of light impinging on the photocoupling device PS-5 prevents voltage across the capacitor C-1 from building high enough to breakover the breakover device and therefor prevents ignition in the manner previously described.

Figure 6:
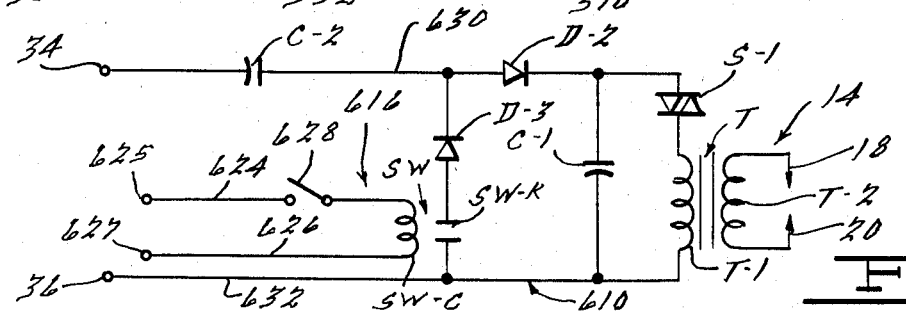
FIG. 6 is a schematic circuit diagram of yet another embodiment of the invention.

Another embodiment of the invention is illustrated in FIG. 6 and is comprised of an ignition system, generally designated 610, which includes the combustion initiator circuit, generally designated 14, previously described. In this embodiment of the invention, a high voltage pulse generator circuit, generally designated 612, is provided which includes the capacitor C-2 and the diode D-2 connected in series therewith, the breakover device S-1 connected in series with the diode D-2, the primary winding T-1 of the step up transformer T connected in series with the breakover device; and the capacitor C-1 connected in parallel with the series combination of the breakover device and the primary winding of the transformer T. As shown in FIG. 6, the leads 630 and 632 are adapted to be connected to the terminals 34 and 36, respectively, of the conventional source of line voltage alternating current. In this embodiment of the invention a diode D-3 is provided in a voltage doubler circuit, conduction of the diode D-3 being controlled by the contacts SW-K of a low voltage relay or reed switch SW.

In this embodiment of the invention, a low voltage control circuit, generally designated 616, is provided which includes the coil SW-C of the relay or reed switch SW, and the leads 624 and 626 of the low voltage control circuit 616 are adapted to be connected to the terminals 625 and 627 of any suitable source of low voltage current, as for example 2 to 4 volts DC current, a low voltage switch 628 being connected in the lead 624 for controlling the energization of the coil SW-C of the relay or reed switch. The switch 628 may be in the form of a conventional thermostatic switch, a manually actuatable switch, a solid state switch or any other switching means effective to control the energization of the coil of the relay or reed switch by making and breaking the circuit thereto.

In the operation of this embodiment of the invention, when the switch 628 is closed, the contacts SW-K are also closed, and the diode D-3 conducts thus doubling the input voltage and causing the breakover device S-1 to breakover thereby effecting ignition in the manner previously described.

When the switch 628 is open, the contacts SW-K are open and the diode D-3 does not conduct, with the result that the voltage across the capacitor C-1 is prevented from building high enough to breakover the breakover device. Ignition is thus prevented until such time as the contacts SW-K are closed by energizing the coil of the relay or reed switch through the agency of the switch 628 incorporated in the low voltage control circuit 616.

It is to be understood that the embodiments of the invention illustrated in FIGS. 5 and 6 provide isolation from line voltage in the same manner as the embodiments of the invention illustrated in FIGS. 1, 2 and 3. It will also be understood that the values of the various resistors, capacitors and diodes in the various embodiments of the invention illustrated and described can readily be determined by those skilled in the art so as to correlate the values of such components with each other and with the breakover voltages of the particular breakover device and the values of the particular photocoupling devices incorporated in the various high voltage pulse generator circuits of systems embodying the present invention.

While preferred embodiments of the invention have been illustrated and described, it will be understood that various changes and modifications may be made without departing from the spirit of the invention.

What is claimed is:

1. In an ignition system, the combination including a high voltage pulse generator circuit, a combustion initiator circuit, a low voltage control circuit, and means interfacing said pulse generator circuit and said combustion initiator circuit, said high voltage pulse generator circuit including a load, a breakover device connected in series with said load, a capacitor connected in parallel with the series combination of said breakover device and said load, a resistor connected to said capacitor, and shunt means connected across said capacitor, said low voltage control circuit including means controlling conduction through said shunt means and additional switch means controlling the energization of said low voltage control circuit.

2. The combination as set forth in claim 1, said means interfacing said pulse generator circuit and said combustion initiator circuit including a step up transformer having a primary winding and a secondary winding, said primary winding of said transformer being connected in series with said breakover device.

3. The combination as set forth in claim 1, said shunt means including voltage divider means.

4. The combination as set forth in claim 1, said shunt means including photoconductive means, said low voltage control circuit including a low voltage light source.

5. The combination as set forth in claim 1, said shunt means including voltage doubling means.

6. The combination as set forth in claim 1, said shunt means including photocoupling means, said low voltage control circuit including a low voltage light source.

7. The combination as set forth in claim 1, said shunt means including a field effect transistor.

8. The combination as set forth in claim 1, said shunt means including a diode and means controlling conduction of said diode.

9. In an ignition system, the combination including a high voltage pulse generator circuit adapted to be connected to a source of high voltage current, a combustion initiator circuit, means interfacing said high voltage pulse generator circuit and said combustion initiator circuit, and a low voltage control circuit adapted to be connected to a source of low voltage current, said high voltage pulse generator circuit including a breakover device connected in series with said interfacing means, a capacitor connected in parallel with said breakover device and said interfacing means, and a resistor connected to said capacitor, and shunt means connected across said capacitor, said low voltage control circuit including means controlling conduction through said shunt means and additional switch means controlling energization of said low voltage control circuit.

10. The combination as set forth in claim 9, said shunt means including voltage divider means.

11. The combination as set forth in claim 9, said shunt means including voltage doubling means.

12. The combination as set forth in claim 9, said shunt means including photocoupling means, said low voltage control circuit including a light source.

13. The combination as set forth in claim 9, said shunt means including a photoelectric cell, said low voltage control circuit including a light source.

14. The combination as set forth in claim 9, said shunt means including a diode and switch means controlling conduction of said diode, said low voltage control circuit including means controlling said switch means in said shunt means.

15. An ignition system comprising, in combination, a high voltage pulse generator circuit adapted to be connected to a source of high voltage current, a combustion initiator circuit, a step up transformer including a primary winding and a secondary winding, said transformer interfacing between said high voltage pulse generator circuit and said combustion initiator circuit, and a low voltage control circuit adapted to be connected to a source of low voltage current, said high voltage pulse generator circuit including a breakover device connected in series with said primary winding of said transformer, a capacitor connected in parallel with said breakover device and said primary winding of said transformer, and a resistor connected to said capacitor, said high voltage pulse generator circuit also including shunt means connected across said capacitor, said low voltage control circuit including means controlling conduction through said shunt means, said low voltage control circuit also including additional means controlling energization of said low voltage control circuit.

16. The combination as set forth in claim 15, said shunt means including voltage divider means.

17. The combination as set forth in claim 15, said shunt means including voltage doubling means.

18. The combination as set forth in claim 15, said shunt means including photocoupling means, said low voltage control circuit including a light source adapted to emit and impinge light on said photocoupling means.

19. The combination as set forth in claim 15, said shunt means including a transistor, said low voltage control circuit including means controlling conduction of said transistor.

20. The combination as set forth in claim 15, said combustion initiator circuit including a pair of spaced electrodes.

21. The combination as set forth in claim 15, said shunt means including a resistor.

* * * * *